United States Patent [19]

Johnson et al.

[11] Patent Number: 4,987,704

[45] Date of Patent: Jan. 29, 1991

[54] PLUNGE JOINTER FOR PLANER KNIVES

[76] Inventors: David J. Johnson, 19909 NE. Clackamas Ct., Portland, Oreg. 97230; Charles L. Groghan, 2632 NE. 201st, Space 10, Troutdale, Oreg. 97060

[21] Appl. No.: 386,942

[22] Filed: Jul. 31, 1989

[51] Int. Cl.[5] ..... B24B 19/00

[52] U.S. Cl. ..... 51/246; 144/114 A

[58] Field of Search ..... 51/246, 247, 250; 144/114 A; 30/138; 56/250

[56] References Cited

U.S. PATENT DOCUMENTS 1,114,743 10/1914 Fosterling ..... 51/246

1,651,013 11/1927 Buss et al. ..... 144/114 A 4,581,856 4/1986 Theien ..... 144/114 A

*Primary Examiner*—Roscoe V. Parker

*Attorney, Agent, or Firm*—E. M. Eckelman

[57] ABSTRACT

A base is arranged to be secured to the support frame of a planer and supports a slide for movement toward and away from the planar knife head. The slide supports a grinding stone, and a lever connected between the base and the slide is arranged to move the slide and the stone toward and away from the knife head. The guard for the knife head on the planer has an opening through which the present jointing apparatus works. An adjustable stop is provided between the jointer base and the slide to provide precision operation of the slide and the stone in jointing operations.

7 Claims, 3 Drawing Sheets

PLUNGE JOINTER FOR PLANER KNIVES

BACKGROUND OF THE INVENTION

This invention relates to new and useful improvements in a plunge jointer for planer knives.

As is known in the trade, cutter head knives on planers must be devoid of sharp corner edges in order that they will perform a planing function efficiently. Thus, jointers are used to periodically shape the knives so that such corner edges are removed. In current practice, when the planer knives require jointing, the planer guard is first removed and jointing apparatus bolted temporarily in place. Such jointer is then operated for its intended purpose. In this procedure, it is required that the planer be stopped during the time that the guard is removed and jointing carried out. This of course means down time which reduces the output efficiency of the planer.

SUMMARY OF THE INVENTION

According to the invention and forming a primary object thereof, a plunge jointer for planers is provided which has improved structural features that allow the jointer to be combined as a permanent part of a planar mechanism and capable of performing its function without shutting down the planer.

A more particular object of the invention is to provide a jointer mechanism of the type described having a novel structure which is arranged to be combined with a planar apparatus and capable of operating through the planer guard wall whereby as noted, the planer does not have to be shut down during operation of the jointer mechanism.

Other objects are to provide a jointer for planers that is simplified in structure, inexpensive to manufacture, and safe and efficient to operate.

In carrying out the above objects, the jointer mechanism comprises a base member secured to the support frame of a planer and slidably supporting a jointer stone holding slide for movement toward and away from the cutter head of the planer. Lever means are connected between the base member and the slide for moving the latter and the stone toward and away from the cutter head. Planer apparatuses have a guard wall adjacent the cutter head to protect personnel from flying shavings, and according to the present invention the jointer stone on the slide operates through an opening in the guard wall for engaging the knives on the cutter head. A slidable door is provided at this opening and is arranged to be raised for allowing the stone to move through the guard wall when jointing is being accomplished and to be returned by gravity to a closed position when the stone is withdrawn. A gauge stud is provided on the slide and is associated with a stop on the base member whereby to provide adjustable, precise jointing positions of the stone.

The invention will be better understood and additional objects and advantages will become apparent from the following description taken in connection with the accompanying drawings.

DETAILED DESCRIPTION OF A PREFERRED EMBODIMENT

Figure 1:
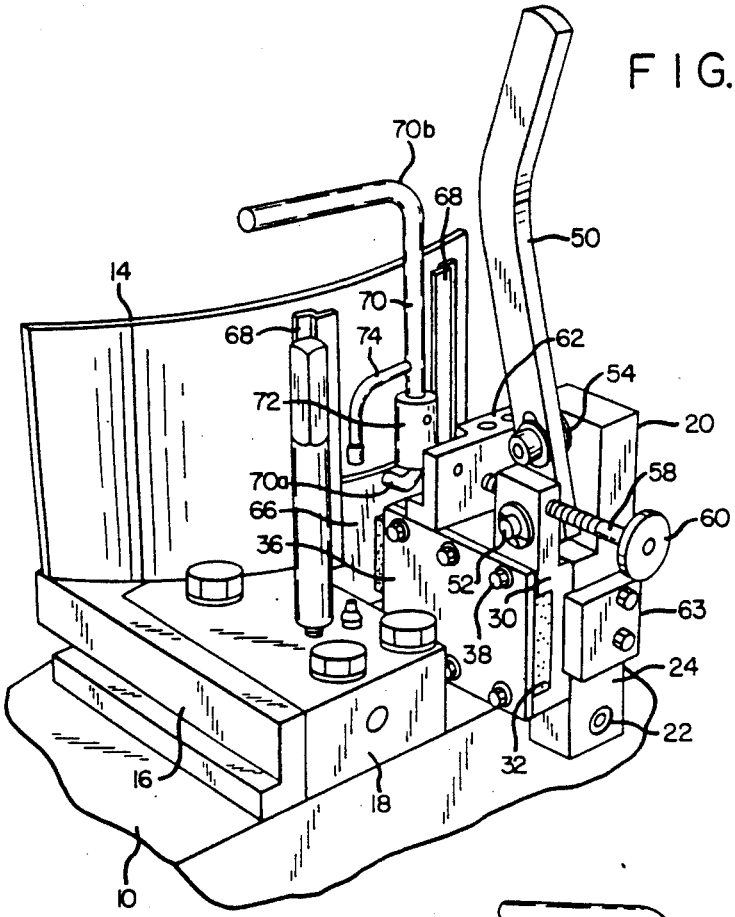
FIG. 1 is a rear perspective view of the present plunge jointer for planers, this view showing the door in the guard wall in closed position and the stone retracted.
Figure 2:
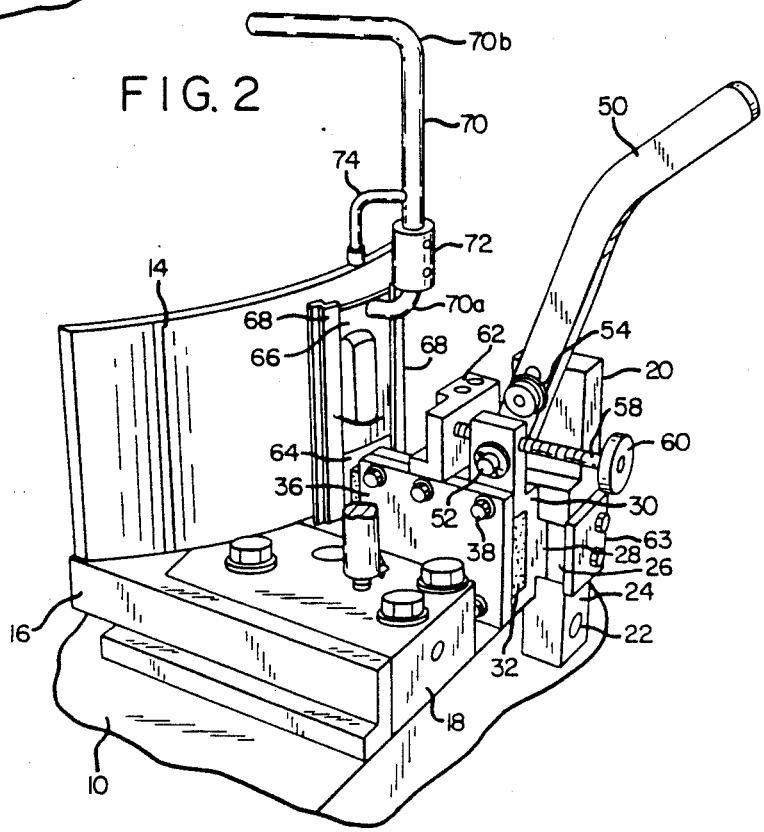
FIG. 2 is a view similar to FIG. 1 but showing the door open and a forward grinding position of the stone.
Figure 3:
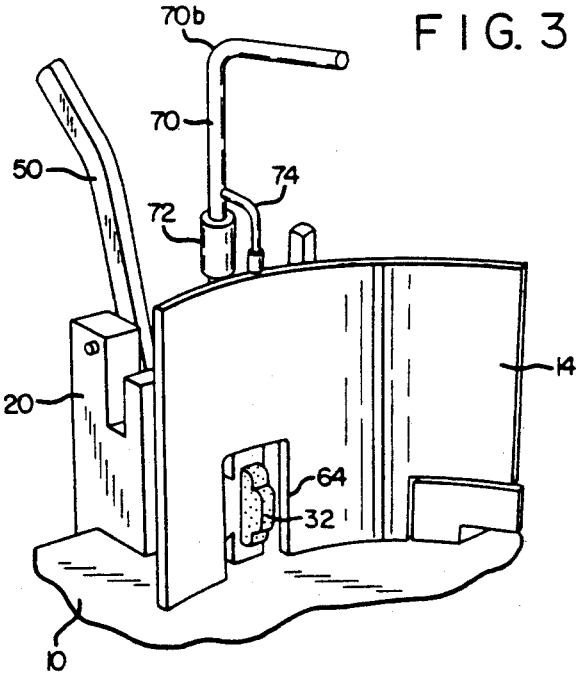
FIG. 3 is a perspective view of the opposite side of the guard wall from that shown in FIGS. 1 and 2.
Figure 4:
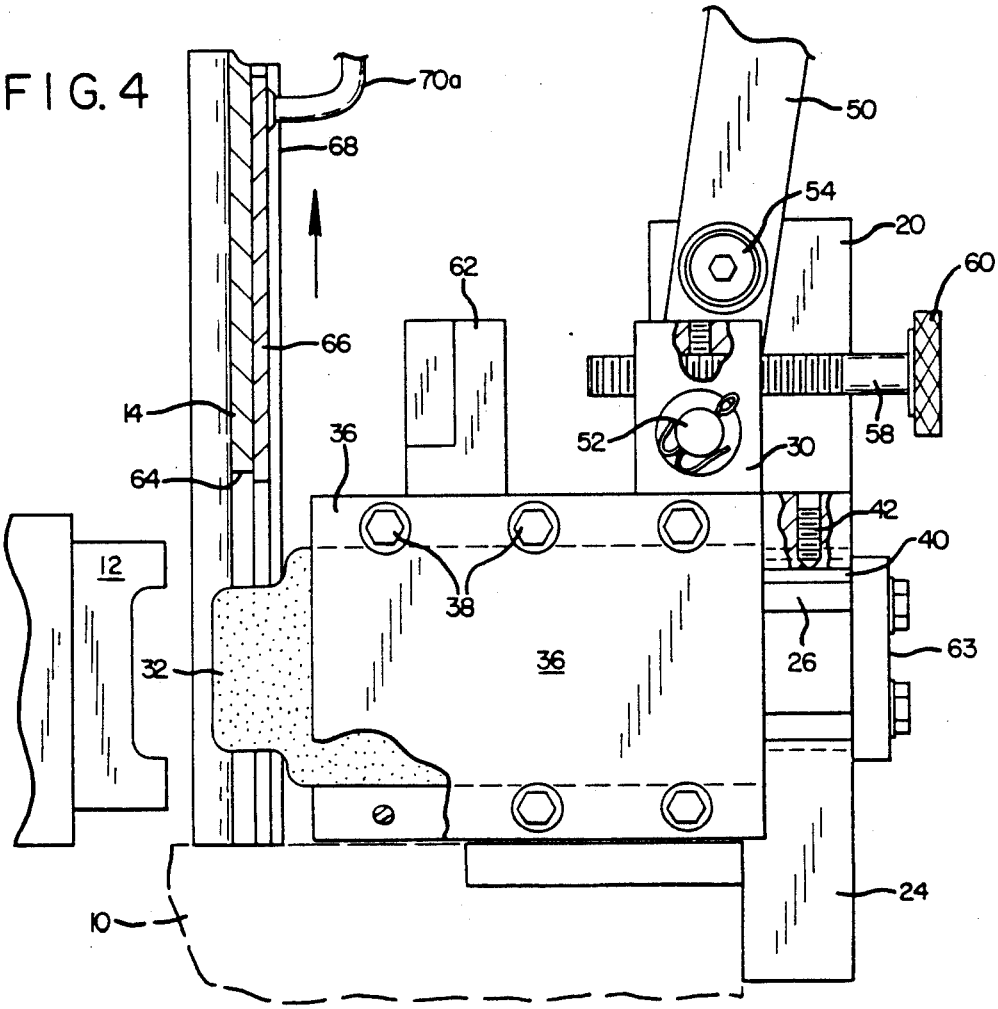
FIG. 4 is an enlarged side elevational view, partly broken away and partly in section, of the present jointer.
Figure 6:
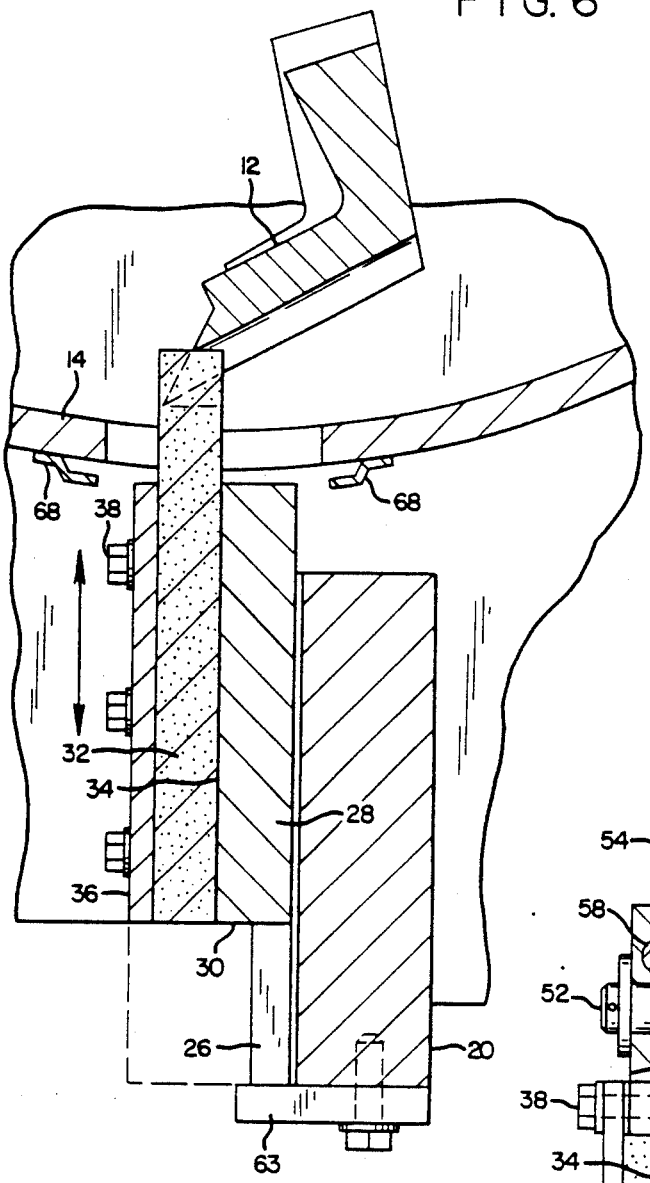
FIG. 6 is a fragmentary sectional view taken on the line 6—6 of FIG. 5.

Conventional lumber planer apparatuses comprise a frame portion that supports one or more high speed cutter heads with knives thereon. The cutter head operates behind a guard wall on the frame. This guard wall has a removable wall section by means of which access can be had to the cutter head for mounting and operating jointing apparatus on the frame. With particular reference to the drawings, the numeral 10 illustrates a conventional planer frame. A portion of a cutter head having the usual knives 12 thereon is shown in FIGS. 4 and 6. The numeral 14 designates a guard wall on the frame to protect personnel from flying planer shavings. In conventional planers, this portion of the guard wall is removable to provide access to the knives for jointing. The numeral 16 designates a conventional lumber guide fence mounted on a base 18 adjustably supported on the planer frame 10.

Figure 5:
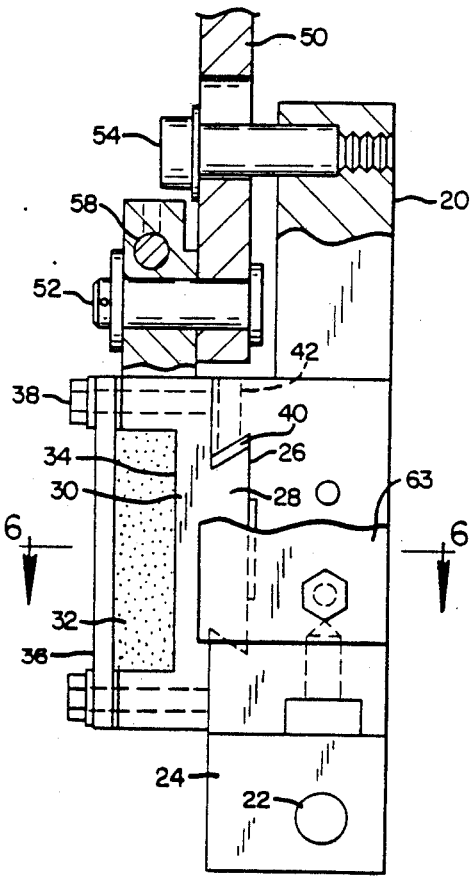
FIG. 5 is a rear elevational view of the jointer with portions thereof broken away.

The present jointer comprises an upstanding slide support base member 20 secured to the planer frame by suitable means such as by screws 22 extending through a depending portion 24 of the base. One side of the base member 20 has a front to rear dovetail slot 26, best seen in FIGS. 5 and 6, that slidably receives a correspondingly shaped projection 28 integral with a stone holding slide body 30. A jointing stone 32 is clamped in a recess 34 in the slide body 30 by a side plate 36 removably mounted in place by a plurality of screws 38. Precision sliding movement of the slide base member 20 in the dovetail slot is maintained, in the event of wear, by a gib plate 40 in one edge of the slot 26 having adjustable engagement with an edge of the dovetail projection 28 of the slide body 30 by one or more set screws 42.

Slide body 30 has driving slidable movement toward the knife head and return by an upstanding hand lever 50 with a pivot connection 52 at its lower end to the slide body and having a pivotal lever support 54 above its lower end on the base 20. The upper end of slide body 30 threadedly supports a horizontal front to rear slide gauge stud 58 having a hand turning knob 60 thereon. Gauge stud 58 is associated with a stop block 62 secured integrally to slide support base 20. By threaded adjustment of the stud 58 in the slide body 30, the association of such stud with the stop block 62 facilitates precise inward movement of the slide body 30 and consequent precise movement of the stone into the knife head for proper jointing. A plate 63 is mounted on the rearward portion of the base member 20 and has a portion thereof, FIG. 6, in the path of the slide body 30 whereby to serve as a rear stop for the slide body.

As pointed out hereinbefore, the guard 14 of existing planers is removed for installing and operating jointer equipment. The planer thus must be shut down. In the present jointer mechanism, however, the slide support base 20 is permanently installed on the frame 10 adjacent the base 18 of the guide fence 16 and the guard 14 is provided with an opening 64 through which the stone can move and engage the knives 12.

A door 66 is provided to close the opening 64 when the present jointer is not in use. This door is slidably confined for vertical movement in side guides 68 and has an upwardly extending handle assembly 70 comprising a first section 70*a* secured to the door and a second section 70*b* attached to the first section by means of a pivot connector 72. Thus, handle section 70*b* can be rotated relative to the cover. Handle section 70*b* has a lateral rest finger 74 secured thereto arranged in a raised position of the door and a rearwardly turned position of the handle section 70*b* to rest on top of the guard wall 14 and hold the door open. The door will drop to its closed position by gravity when the handle section 70*b* is turned forwardly and released.

According to the invention, the opening 66 is cut in the guard wall 14 in alignment with the stone and as determined by the mounted positioning of the base member 20. The base member 20 is mounted permanently on the planer frame, and when it is desired to joint the knife head, it is merely necessary to open the door 66 and operate the jointer by operation of the lever 50. The guard wall 14 does not have to be removed and thus the jointer can be operated while the planer is in full operation. Thus, there will be no down time and the planer can run at full efficiency. By selected threaded adjustment of the gauge stud 58, the slide body 30 and the stone can be adjusted for wear of the stone or knives. The stone also can be adjusted in the slide body by changing its clamped longitudinal positioning in the slide body 30, thus utilizing maximum length usage thereof.

It is to be understood that the form of our invention herein shown and described is to be taken as a preferred example of the same and that various changes in the shape, size and arrangement of parts may be resorted to without departing from the spirit of our invention, or the scope of the subjoined claims.

Having thus described our invention, we claim:

1. In a planar apparatus:

a frame, a rotatable knife head on said frame, a guard wall on said frame adjacent said knife head, a base member arranged to be secured to said support frame on a side of said guard wall opposite from said knife head, slide means slidably mounted on said base member for movement toward and away from said knife head, a jointing stone on said slide means having a jointing portion projecting from said slide means, and lever means on said base member engageable with said slide means and arranged to move said slide means and stone toward and away from said knife head, said lever means being arranged to move said slide means past said guard wall for engagement of the jointing stone with the knife head for jointing the knife head.

2. The planer apparatus of claim 1 including an opening in said guard wall through which said jointing stone operates to joint said knife head.

3. The planer apparatus of claim 2 including a door arranged normally to close said opening but to be opened when said slide means and jointing stone are moved to joint the knife head.

4. The planer apparatus of claim 2 including a door arranged normally to close said opening but to be opened when said slide means and jointing stone are moved to joint the knife head, and rest means on said door arranged to hold it open in an elevated position or to allow it to close by gravity.

5. The planer apparatus of claim 1 including an adjusting gauge stud on one of said base member and slide means and a stop on the other of said base member and slide means engageable by said gauge stud providing an adjustable jointing position of said jointing stone.

6. The planer apparatus of claim 1 including an adjusting gauge stud on one of said base member and slide means and a stop on the other of said base member and slide means engageable by said gauge stud providing an adjustable jointing position of said grinding stone, and means clamping said jointing stone on said slide means for adjusted positioning toward said grinding head.

7. The planer apparatus of claim 1 wherein said slidable mounting of said slide means on said base member comprises an elongated dovetail connection therebetween, and slack takeup means in said dovetail connection arranged to adjust for wear therein.

* * * * *